US005845496A

United States Patent [19]

Bachmann

[11] Patent Number: 5,845,496

[45] Date of Patent: Dec. 8, 1998

[54] METHOD OF OPERATING A STEAM TURBINE

[75] Inventor: Rolf Bachmann, Döttingen, Switzerland

[73] Assignee: Asea Brown Boveri AG, Baden, Switzerland

[21] Appl. No.: 587,969

[22] Filed: Jan. 17, 1996

[30] Foreign Application Priority Data

Feb. 27, 1995 [DE] Germany ..... 195 06 787.8

[51] Int. Cl.[6] ..... F01K 13/02

[52] U.S. Cl. ..... 60/646; 60/666

[58] Field of Search ..... 60/517, 525, 646, 60/666

[56] References Cited

U.S. PATENT DOCUMENTS 4,448,026 5/1984 Binstock et al. ..... 60/666
4,598,551 7/1986 Dimitroff, Jr. et al. ..... 60/646

*Primary Examiner*—Noah P. Kamen
*Attorney, Agent, or Firm*—Burns, Doane, Swecker & Mathis, L.L.P.

[57] ABSTRACT

In a method of operating a steam turbine which consists of at least two separate turbine sections (11, 15), working at different pressures from one another, and works with at least one reheat, in which arrangement the steam is directed to at least one reheater (13) after flowing through the separate turbine section of higher pressure (11), is heated in said reheater (13) and is then fed to the separate turbine section of lower pressure (15), the separate turbine section of lower pressure (15) is fed with cooler steam during the starting and run-up phase than during full-load/continuous operation. This is done, for example, owing to the fact that at least some of the exhaust steam from the separate turbine section of higher pressure (11) is directed via a bypass (18) directly into the separate turbine section of lower pressure (15) during the run-up phase of the turbine, and all the exhaust steam from the separate turbine section of higher pressure (11) is directed into the reheater (13) only upon reaching full-load or in continuous operation, is heated in said reheater (13) and is then fed to the separate turbine section of lower pressure (15). Injection of water into the hot reheater steam is likewise possible. The starting time of the turbine is thereby reduced.

3 Claims, 1 Drawing Sheet

8
13
9
24
14
19
12
22
16
10
18
7
1
6
2
5
G
G
11
15
3
4
17

13
13a 19
18
19a
18a
16
G
11
20
15

METHOD OF OPERATING A STEAM TURBINE

BACKGROUND OF THE INVENTION

1. Field of the Invention

The invention relates to a method of operating a steam turbine having at least two separate turbine sections working at different pressures, the term separate turbine sections also being intended below to mean various stages of a single-cylinder steam turbine, in which method at least one steam circuit having reheating is used.

2. Discussion of Background

Methods of operating steam turbines with reheating are known (Lueger, Lexikon der Energietechnik und Kraftmaschinen, Deutsche Verlags-Anstalt Stuttgart, 4th edition 1965, volume 7, page 619).

The temperature of the steam which has already performed work in the high-pressure part of a steam turbine is raised again by reheating and thus the available gradient is increased before the steam passes into the low-pressure part of the turbine. The efficiency of the plant is thereby increased.

A further advantage of the operation of steam or combined power plants with reheating of the steam consists in the fact that the final wetness of the steam in the final stages of the turbine is reduced by the reheating and the fluidic quality and the service life are thereby improved.

Reheating is effected by returning the steam to the boiler into special reheater coils heated by flue gas or by passing the steam into special reheaters which are heated by superheated, flowing or condensable live steam.

Reheating is used in steam engines when the steam becomes too wet during the expansion in the engine. The steam in this case, after flowing through a number of stages, is directed out of the turbine to the reheater and then fed back to the turbine. In the case of very high pressure gradients, multiple reheating is used in order to ensure that there is no excessive wetness of the steam in the last stage.

Apart from these advantages, however, the reheater circuits have the disadvantage of a longer starting time, especially in combined power plants.

SUMMARY OF THE INVENTION

Accordingly, one object of the invention, in attempting to avoid this disadvantage, is to reduce the starting time during run-up in a steam turbine which consists of at least two separate turbine sections, working at different pressures, and works with reheating and which is used in both combined power plants and conventionally fired steam power plants.

According to the invention this is achieved when, in a method of operating a steam turbine which consists of at least two separate turbine sections, working at different pressures from one another, and works with at least one reheat, in which arrangement the steam is directed to at least one reheater after flowing through the separate turbine section of higher pressure, is heated in said reheater and is then fed to the separate turbine section of lower pressure, the separate turbine section of lower pressure is fed with cooler steam during the starting and run-up phase than during full-load/continuous operation.

The advantages of the invention consist in a reduction in the starting time of the steam turbine and in a reduction in the mechanical loading.

It is of advantage if at least some of the exhaust steam from the separate turbine section of higher pressure is directed via a bypass directly into the separate turbine section of lower pressure during the run-up phase of the turbine, and all the exhaust steam from the separate turbine section of higher pressure is directed into the reheater only upon reaching full-load or in continuous operation, is heated in said reheater and is then fed to the separate turbine section of lower pressure.

Furthermore it is expedient if the hot reheater steam is cooled by means of water injection during the run-up phase of the turbine before it is directed into the separate turbine section of lower pressure.

It is advantageous if the exhaust-steam flow directed via the bypass line directly to the separate turbine section of lower pressure is cooled by means of water injection in the bypass, since in this way there are sufficient means of controlling the steam turbine in the run-up phase.

It is especially expedient if all the exhaust steam from the separate turbine section of higher pressure is directed via the bypass directly into the separate turbine section of lower pressure during the run-up phase of the steam turbine. The separate turbine section of lower pressure may then be run up with relatively cold steam so that very quick run-up of the steam turbine is possible.

Furthermore, it is advantageous if the quantity of bypass flow is controlled as a function of the state of the steam turbine before and during the start and/or of the throughflow requirements of the reheater.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein two exemplary embodiments of the invention are shown with reference to a steam-turbine group consisting of a plurality of separate turbine sections which are integrated in a combined power plant and wherein.

Only the elements essential for understanding the invention are shown. Elements of the plant which are not shown are, for example, the deaerator/feedwater tank. The direction of flow of the media is designated by arrows.

DESCRIPTION OF THE PREFERRED EMBODIMENTS

Figure 1:
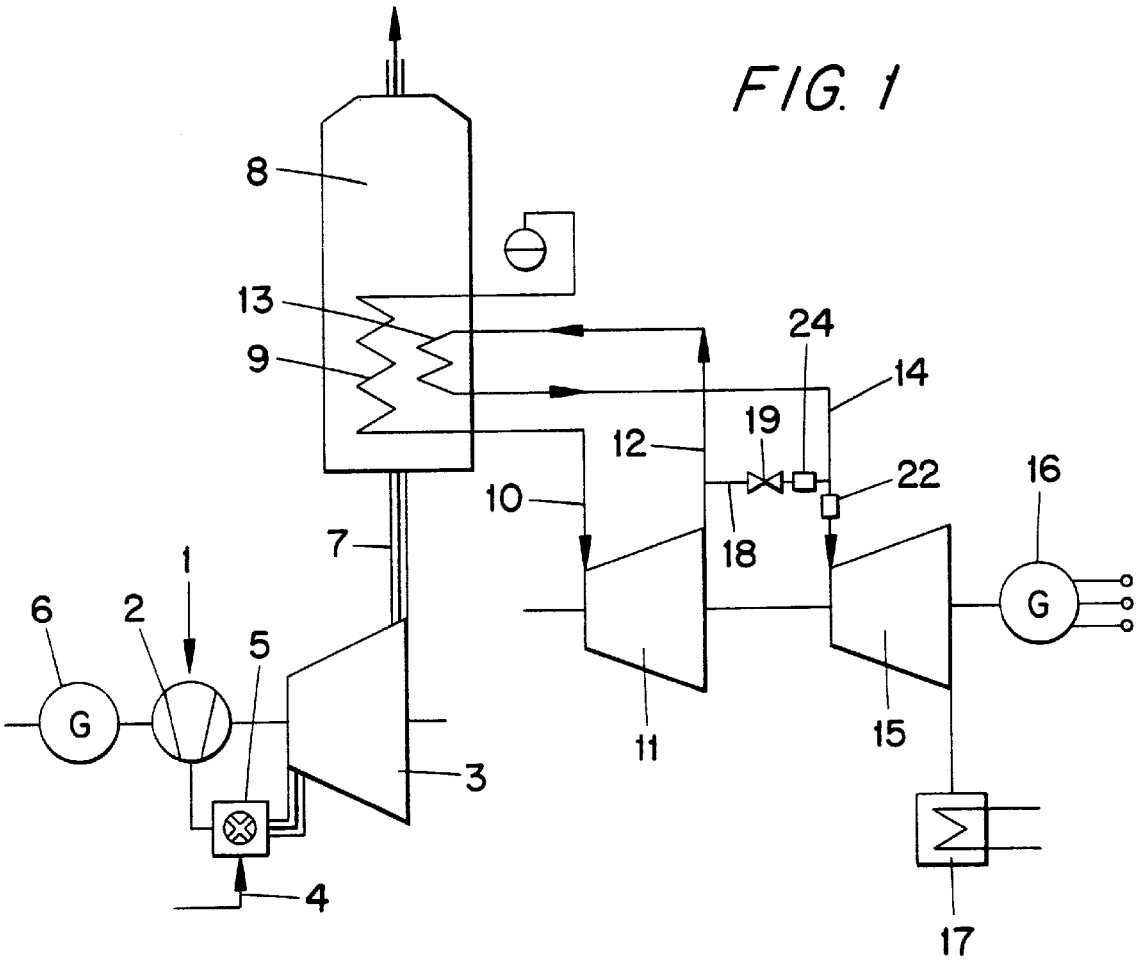
FIG. 1 shows a schematic arrangement of gas-turbine group, waste-heat boiler, steam-turbine group, reheater and generator in a combined power plant, the steam turbine consisting of a separate high-pressure (HP) and a separate low-pressure (LP) turbine section.

Referring now to the drawings, wherein like reference numerals designate identical or corresponding parts throughout the several views, in the combined power plant shown schematically in FIG. 1 ambient air 1 is drawn in and passed through a filter system into the compressor 2 of the gas turbine 3. The air is compressed in the compressor 2, then mixed with fuel 4 and burned in the combustion chamber 5. The resulting combustion gases drive the gas turbine 3. Electric energy is produced by the generator 6 coupled to the gas turbine 3.

The hot exhaust gases 7 of the gas turbine 3 pass via the exhaust-gas duct into the waste-heat boiler 8. Most of the heat still present is removed from them there and transferred to a water/steam circuit before they pass into the atmosphere through a stack.

The waste-heat boiler 8 consists of various heat-exchanger sections 9. First of all the water is heated in the economizer almost up to the saturation temperature. It is then converted into steam in the evaporator. The saturated steam is then heated further in the superheater. The live steam obtained now passes via a high-pressure steam line 10 into the high-pressure (HP) steam turbine 11, where it is partly expanded.

The partly expanded steam now passes via an exhaust-steam line 12 into the reheater 13, is heated there and directed via the line 14 into the separate low-pressure (LP) turbine section 15. Thermal energy is converted into mechanical energy in the HP and LP turbine 11, 15, the steam turbine in turn being coupled to a generator 16, which generates current.

After leaving the separate LP turbine section 15, the exhaust steam is converted into water in a condenser 17. The water is passed into the feedwater tank (not shown here), in which the non-condensable gases are also removed. Via feedwater pumps (likewise not shown in FIG. 1), the water is fed back under pressure into the waste-heat boiler 8.

According to the invention, a bypass line 18 branches off from the exhaust-steam line 12 leading to the reheater 13, which bypass line 18 extends directly to the inlet of the LP turbine 15 so that cooler exhaust steam can be admitted to the separate LP turbine section in the starting and run-up phase.

In the run-up phase, at least some of the exhaust steam is directed from the HP turbine 11 via the bypass line 18 directly into the LP turbine 15. The rest of the exhaust steam is directed into the reheater 13 and heated there before it is fed to the LP turbine 15. The mixing of the two flows may be effected in this case upstream of the LP turbine 15 or directly at the inlet to the turbine 15.

The bypass 18 is opened via a regulating valve 19. The opening may be matched to the state of the steam turbine before and during starting in order to guarantee optimum run-up. Thus, during a cold start for example, when the steam turbine is at room temperature, the separate LP turbine section 15 is run up with relatively cool steam, e.g. at 300° C., since otherwise the state of stress is too high. Here, therefore, in the starting phase, the entire exhaust-steam flow from the HP turbine 11 is directed via the bypass line 18 and is fed to the reheater 13 only after the run-up phase.

On the other hand, if run-up is effected again after an emergency shutdown, when the steam turbine is still warm, e.g. at 500° C., partial reheating of the exhaust steam from the HP turbine 11 is carried out and a mixture of reheated steam from the reheater 13 and exhaust steam from the HP turbine 11 is admitted to the LP turbine 15.

The engine is run up according to a characteristic which takes into account the state of stress of the separate LP turbine section by a temperature measurement being taken, for example just before the LP turbine, the signals of which temperature measurement control the valve 19.

In addition, it is also possible to adapt the opening of the valve 19 and thus of the bypass line 18 to the throughflow requirements of the reheater 13. This enables the starting time of the steam turbine to be reduced compared with the prior art (without exhaust steam from the HP turbine 11 bypassing the reheater 13). A further advantage consists in the fact that the use of the bypass stabilizes the pressures in the reheater circuit, as is required by the boiler or by the steam turbine.

If the HP turbine is too hot, exhaust steam may also be passed directly into the condenser via a bypass not shown in FIG. 1, which serves to stabilize the system.

In full-load operation or in continuous operation, the valve 19 is closed so that all the exhaust steam is passed from the HP turbine 11 via the reheater 13 before the LP turbine 15 is loaded.

The invention is of course not restricted to the exemplary embodiment just described. Instead of being used in a steam turbine consisting of spatially separate HP and LP turbines, the method according to the invention may also be used in a single-cylinder steam turbine with reheating.

Figure 2:
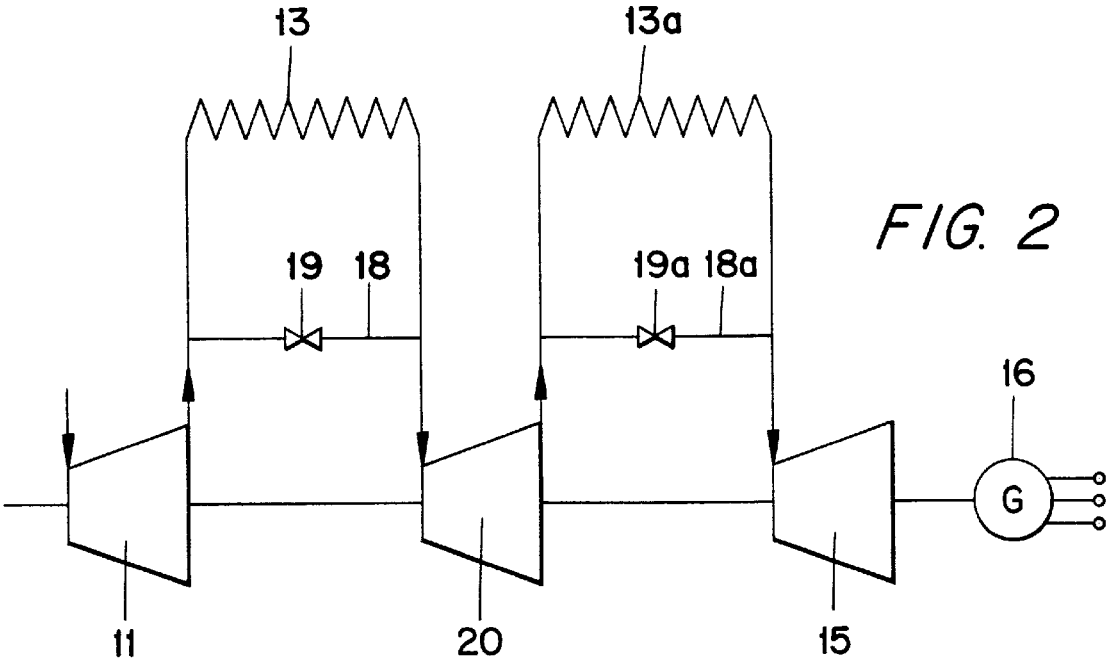
FIG. 2 shows a schematic representation of a triple-pressure steam-turbine group having reheating between the different pressure stages and alternative bypassing of the reheater.

FIG. 2 schematically shows a further exemplary embodiment. Here, a steam-turbine group is shown in which there are separate HP, intermediate-pressure (IP) and LP turbine sections 11, 20, 15, and a reheater circuit 13, 13*a* for the steam is provided in each case between HP and IP turbine 11, 20 and between IP and LP turbine 20, 15. In each case the quantity of steam which is heated in the reheaters 13, 13*a* or the quantity of steam not passed via the reheaters 13, 13*a* can be varied by means of the bypass lines 18, 18*a* and the valves 19, 19*a*.

Furthermore, a conventionally fired steam power plant can be operated and the abovementioned advantages achieved by this method.

In addition, it is possible to reduce the starting time of the steam turbine and the mechanical loads if, during the run-up phase, instead of at least some of the exhaust steam from the HP turbine 11 bypassing the reheater 13, the exhaust steam is directed into the hot reheater 13 and cooled before introduction into the LP turbine 15. In the line 14, a water injection means is provided to inject water into the reheated steam. It is also an easy matter to use a combination of the two possibilities by providing a water injector 24 in the line 18 bypassing the reheater and to inject water into the exhaust flow.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a steam turbine having at least a higher pressure turbine and a lower pressure section, and at least one reheat circuit between turbine sections, the method comprising the steps of:

directing steam to the at least one reheater from the separate turbine section of higher pressure for reheating, feeding the reheated steam to the separate turbine section of lower pressure, and wherein, during a starting and run-up phase until fall-load/continuous operation is reached, the method further comprises the step of injecting water into the reheated steam to cool the reheated steam before feeding the reheated steam to the lower pressure turbine section.

2. A method of operating a steam turbine having at least a higher pressure turbine and a lower pressure section, and at least one reheat circuit between turbine sections, the method comprising the steps of:

directing steam to the at least one reheater from the separate turbine section of higher pressure for reheating, and feeding the reheated steam to the separate turbine section of lower pressure, wherein, during a starting and run-up phase until fill-load/continuous operation is reached, the method comprises the steps of directing at least a portion of exhaust steam from the higher pressure turbine section through a bypass line directly into the lower pressure turbine section and injecting water into the steam in the bypass line for cooling.

3. The method as claimed in claim 2, wherein all of the exhaust steam from the higher pressure turbine section is directed through the bypass line into the lower pressure turbine section during the starting and run-up phase.

* * * * *